US010044172B2

(12) United States Patent
Ma

(10) Patent No.: US 10,044,172 B2
(45) **Date of Patent: *Aug. 7, 2018**

(54) ELECTRODE FOR SPARK PLUG COMPRISING RUTHENIUM-BASED MATERIAL

(71) Applicant: FEDERAL-MOGUL IGNITION COMPANY, Southfield, MI (US)

(72) Inventor: Shuwei Ma, Ann Arbor, MI (US)

(73) Assignee: FEDERAL-MOGUL IGNITION COMPANY, Southfield, MI (US)

( * ) Notice: Subject to any disclaimer, the term of this patent is extended or adjusted under 35 U.S.C. 154(b) by 471 days.

This patent is subject to a terminal disclaimer.

(21) Appl. No.: 13/870,631

(22) Filed: Apr. 25, 2013

(65) Prior Publication Data

US 2013/0285533 A1 Oct. 31, 2013

Related U.S. Application Data

(60) Provisional application No. 61/639,174, filed on Apr. 27, 2012.

(51) Int. Cl.
*H01T 13/39* (2006.01)

(52) U.S. Cl.
CPC ..... *H01T 13/39* (2013.01)

(58) Field of Classification Search
CPC ..... H01T 13/39
USPC ..... 313/141
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Jones et al. |

(Continued)

FOREIGN PATENT DOCUMENTS

| | | | |
|---|---|---|---|
| DE | 10005559 | 8/2001 | |
| EP | 1123985 A1 * | 8/2001 | ..... C22C 5/04 |

(Continued)

OTHER PUBLICATIONS

Machine translation of EP 1123985, retrieved May 29, 2014.*

(Continued)

*Primary Examiner* — Anh Mai
*Assistant Examiner* — Steven Horikoshi
(74) *Attorney, Agent, or Firm* — Reising Ethington, P.C.

(57) ABSTRACT

An electrode material that may be used in spark plugs and other ignition devices including industrial plugs, aviation igniters, glow plugs, or any other device that is used to ignite an air/fuel mixture in an engine. In one embodiment, the electrode material is a ruthenium-based material that includes ruthenium (Ru) as the single largest constituent on a wt % basis, and at least one of rhenium (Re) or tungsten (W). The electrode material may further include one or more precious metals and/or rare earth metals. The electrode material may be used to form the center electrode, the ground electrode, firing tips, or other firing tip components.

22 Claims, 4 Drawing Sheets

(56) References Cited

U.S. PATENT DOCUMENTS

| | | | | |
|---|---|---|---|---|
| 3,466,158 | A | 9/1969 | Rhys | |
| 3,528,862 | A | 9/1970 | Jones et al. | |
| 3,868,430 | A | 2/1975 | Giangaspero | |
| 3,868,530 | A * | 2/1975 | Eaton et al. | 313/141 |
| 3,957,451 | A | 5/1976 | Rasmussen et al. | |
| 2,977,841 | A | 8/1976 | Rasmussen et al. | |
| 4,324,588 | A | 4/1982 | Zysk et al. | |
| 4,351,095 | A | 9/1982 | Davies | |
| 4,427,915 | A | 1/1984 | Nishio et al. | |
| 4,659,960 | A | 4/1987 | Toya | |
| 4,692,657 | A | 9/1987 | Grunwald et al. | |
| 4,743,793 | A | 5/1988 | Toya et al. | |
| 4,771,209 | A | 9/1988 | Ryan | |
| 4,786,267 | A | 11/1988 | Toya et al. | |
| 4,881,913 | A | 11/1989 | Mann | |
| 4,910,428 | A | 3/1990 | Strumbos | |
| 4,939,409 | A | 7/1990 | Freise et al. | |
| 5,101,135 | A | 3/1992 | Oshima | |
| 5,347,193 | A | 9/1994 | Oshima | |
| 5,448,130 | A | 9/1995 | Matsutani et al. | |
| 5,456,624 | A | 10/1995 | Moore | |
| 5,461,275 | A | 10/1995 | Oshima | |
| 5,514,929 | A | 5/1996 | Kawamura | |
| 5,550,425 | A | 8/1996 | Yoder | |
| 5,578,895 | A | 11/1996 | Oshima | |
| 5,675,209 | A | 10/1997 | Hall, Jr. | |
| 5,793,793 | A | 8/1998 | Matsutani et al. | |
| 5,796,019 | A | 8/1998 | Lupton | |
| 5,866,973 | A | 2/1999 | Kagawa et al. | |
| 5,869,921 | A | 2/1999 | Matsutani | |
| 5,890,272 | A | 4/1999 | Liberman | |
| 5,894,186 | A | 4/1999 | Matsutani et al. | |
| 5,898,257 | A | 4/1999 | Sequerra et al. | |
| 5,990,602 | A | 11/1999 | Katoh et al. | |
| 5,997,695 | A | 12/1999 | Limarinen | |
| 5,998,913 | A | 12/1999 | Matsutani et al. | |
| 6,045,424 | A | 4/2000 | Chang et al. | |
| 6,046,532 | A | 4/2000 | Katoh et al. | |
| 6,071,163 | A | 6/2000 | Chang et al. | |
| 6,094,000 | A | 7/2000 | Osamura et al. | |
| 6,095,124 | A | 8/2000 | Matsubara et al. | |
| 6,121,719 | A | 9/2000 | Matsutani et al. | |
| 6,166,479 | A | 12/2000 | Matasutani et al. | |
| 6,262,522 | B1 | 7/2001 | Osamura et al. | |
| 6,304,022 | B1 | 10/2001 | Matsutani et al. | |
| 6,326,719 | B1 | 12/2001 | Boehler | |
| 6,407,487 | B1 | 6/2002 | Sugimoto | |
| 6,412,465 | B1 * | 7/2002 | Lykowski et al. | 123/169 EL |
| 6,523,515 | B2 | 2/2003 | Kanao | |
| 6,533,628 | B1 | 3/2003 | Matsutani | |
| 6,579,738 | B2 | 6/2003 | Farrar | |
| 6,611,083 | B2 | 8/2003 | LaBarge et al. | |
| 6,628,051 | B1 | 9/2003 | Menken | |
| 6,664,719 | B2 | 12/2003 | Matsutani et al. | |
| 6,750,597 | B1 | 6/2004 | Sakura | |
| 6,790,113 | B1 | 9/2004 | Fujita | |
| 6,794,803 | B2 | 9/2004 | Hori et al. | |
| 6,798,125 | B2 | 9/2004 | Sugiyama et al. | |
| 6,864,622 | B2 | 3/2005 | Matsutani et al. | |
| 6,869,328 | B2 | 3/2005 | Ulm et al. | |
| 7,084,558 | B2 | 8/2006 | Teramura et al. | |
| 7,131,191 | B2 | 11/2006 | Matsutani et al. | |
| 7,132,782 | B2 | 11/2006 | Kato et al. | |
| 7,150,252 | B2 | 12/2006 | Sugiyama et al. | |
| 7,164,225 | B2 | 1/2007 | Yoshimoto et al. | |
| 7,221,078 | B2 | 5/2007 | Watanabe | |
| 7,279,827 | B2 | 10/2007 | Nunome et al. | |
| 7,288,879 | B2 | 10/2007 | Matsutani et al. | |
| 7,321,187 | B2 | 1/2008 | Teramura et al. | |
| 7,336,024 | B2 | 2/2008 | Yoshimoto et al. | |
| 7,382,084 | B2 | 6/2008 | Yoshimoto et al. | |
| 7,385,339 | B2 | 6/2008 | Lineton et al. | |
| 7,449,823 | B2 | 11/2008 | Menken et al. | |
| 7,569,979 | B2 | 8/2009 | Lykowski et al. | |
| 7,637,793 | B2 | 12/2009 | Lintunen et al. | |
| 7,815,849 | B2 | 10/2010 | Koch et al. | |
| 8,471,451 | B2 * | 6/2013 | Ma | 313/141 |
| 8,575,830 | B2 * | 11/2013 | Ma | 313/141 |
| 2002/0024160 | A1 | 2/2002 | Sugimoto | |
| 2003/0011013 | A1 * | 1/2003 | Joo et al. | 257/309 |
| 2003/0178925 | A1 | 9/2003 | Kumagai | |
| 2004/0140745 | A1 | 7/2004 | Hrastnik | |
| 2004/0239223 | A1 * | 12/2004 | Watanabe | 313/141 |
| 2005/0168121 | A1 | 8/2005 | Tinwell | |
| 2005/0179353 | A1 | 8/2005 | Watanabe | |
| 2005/0194878 | A1 * | 9/2005 | Watanabe | 313/141 |
| 2006/0158082 | A1 | 7/2006 | Menken | |
| 2006/0165554 | A1 * | 7/2006 | Coupland et al. | 420/461 |
| 2007/0057613 | A1 | 3/2007 | Brady | |
| 2007/0190364 | A1 | 8/2007 | Das | |
| 2007/0236123 | A1 | 10/2007 | Lykowski | |
| 2007/0236124 | A1 | 10/2007 | Lykowski | |
| 2008/0074025 | A1 | 3/2008 | Hori | |
| 2008/0206601 | A1 | 8/2008 | Mukai | |
| 2008/0308057 | A1 | 12/2008 | Lykowski | |
| 2009/0107440 | A1 * | 4/2009 | Lykowski et al. | 123/169 EL |
| 2009/0284117 | A1 | 11/2009 | Lykowski | |
| 2010/0026159 | A1 | 2/2010 | Ohm | |
| 2010/0052497 | A1 | 3/2010 | Walker, Jr. | |
| 2010/0109502 | A1 | 5/2010 | Nakayama | |
| 2010/0117506 | A1 | 5/2010 | Suzuki et al. | |
| 2010/0253203 | A1 | 10/2010 | Suzuki et al. | |
| 2010/0264801 | A1 | 10/2010 | Tanaka | |
| 2010/0264802 | A1 | 10/2010 | Tanaka | |
| 2011/0043093 | A1 | 2/2011 | Nunome | |
| 2011/0127900 | A1 | 6/2011 | Ma | |
| 2011/0198983 | A1 | 8/2011 | Manhardt | |
| 2012/0025690 | A1 | 2/2012 | Kohl | |
| 2012/0025692 | A1 | 2/2012 | Ma | |

FOREIGN PATENT DOCUMENTS

| | | |
|---|---|---|
| GB | 556253 | 9/1943 |
| GB | 575998 | 3/1946 |
| GB | 717496 | 10/1954 |
| GB | 755835 | 8/1956 |
| GB | 830628 | 3/1960 |
| GB | 1032005 A * | 7/1971 |
| JP | 2207476 | 8/1990 |
| JP | 7268574 | 10/1995 |
| JP | 8339880 | 12/1996 |
| JP | 2000331770 | 11/2000 |
| JP | 2001262253 | 9/2001 |
| JP | 2002346625 | 12/2002 |
| JP | 2003053419 | 2/2003 |
| JP | 2004031300 | 1/2004 |
| JP | 2004152682 | 5/2004 |
| JP | 2004235040 | 8/2004 |
| JP | 2008053017 | 3/2008 |
| JP | 2008053018 | 3/2008 |
| KR | 20020050486 | 6/2002 |

OTHER PUBLICATIONS

U.S. Appl. No. 13/402,437.*

U.S. Appl. No. 13/533,264.*

Excerpt of Tungsten Prices from Metal Prices in the United States Through 2010, retrieved from http://pubs.usgs.gov/sir/2012/5188/sir2012-5188.pdf, retrived on Mar. 5, 2015, published 2013.*

Definition of Synergy, retrieved from Dictionary.Reference.com on Oct. 19, 2015.*

International Search Report for PCT/US2010/058501, dated Aug. 31, 2011, 3 pages.

Written Opinion & International Search Report for PCT/US11/45767, dated Mar. 20, 2012, 11 pages.

Written Opinion & International Search Report for PCT/US12/044160, dated Jan. 25, 2013, 9 pages.

* cited by examiner

ELECTRODE FOR SPARK PLUG COMPRISING RUTHENIUM-BASED MATERIAL

REFERENCE TO RELATED APPLICATIONS

This application claims the benefit of U.S. Provisional Ser. No. 61/639,174 filed on Apr. 27, 2012, the entire contents of which are incorporated herein by reference.

TECHNICAL FIELD

This disclosure generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one aspect, there is provided a spark plug, comprising: a metallic shell having an axial bore; an insulator having an axial bore and being at least partially disposed within the axial bore of the metallic shell; a center electrode being at least partially disposed within the axial bore of the insulator; and a ground electrode being attached to the metallic shell. The center electrode, the ground electrode or both the center and ground electrodes includes a ruthenium-based electrode material having ruthenium (Ru), rhenium (Re) and tungsten (W), wherein the ruthenium (Ru) is the single largest constituent of the electrode material on a weight percentage (wt %) basis.

According to another aspect, there is provided a spark plug, comprising: a metallic shell having an axial bore; an insulator having an axial bore and being at least partially disposed within the axial bore of the metallic shell; a center electrode being at least partially disposed within the axial bore of the insulator; and a ground electrode being attached to the metallic shell. The center electrode, the ground electrode, or both the center and ground electrodes includes a ruthenium-based electrode material having ruthenium (Ru), rhodium (Rh), and at least one of rhenium (Re) or tungsten (W), wherein the ruthenium (Ru) is the single largest constituent of the electrode material on a weight percentage (wt %) basis and the rhodium (Rh) is the second largest constituent of the electrode material on a weight percentage (wt %) basis.

According to another aspect, there is provided an electrode for a spark plug, comprising: a ruthenium-based electrode material having ruthenium (Ru), rhenium (Re) and tungsten (W), wherein the ruthenium (Ru) is the single largest constituent of the electrode material on a weight percentage (wt %) basis. The electrode material includes a grain microstructure that has rhenium-rich and tungsten-rich grain boundaries that are arranged to constrain ruthenium (Ru) grain growth during one or more hot forming processes.

BRIEF DESCRIPTION OF THE DRAWINGS

Preferred exemplary embodiments of the disclosure will hereinafter be described in conjunction with the appended drawings, wherein like designations denote like elements, and wherein.

DETAILED DESCRIPTION OF THE PREFERRED EMBODIMENTS

Figure 1:
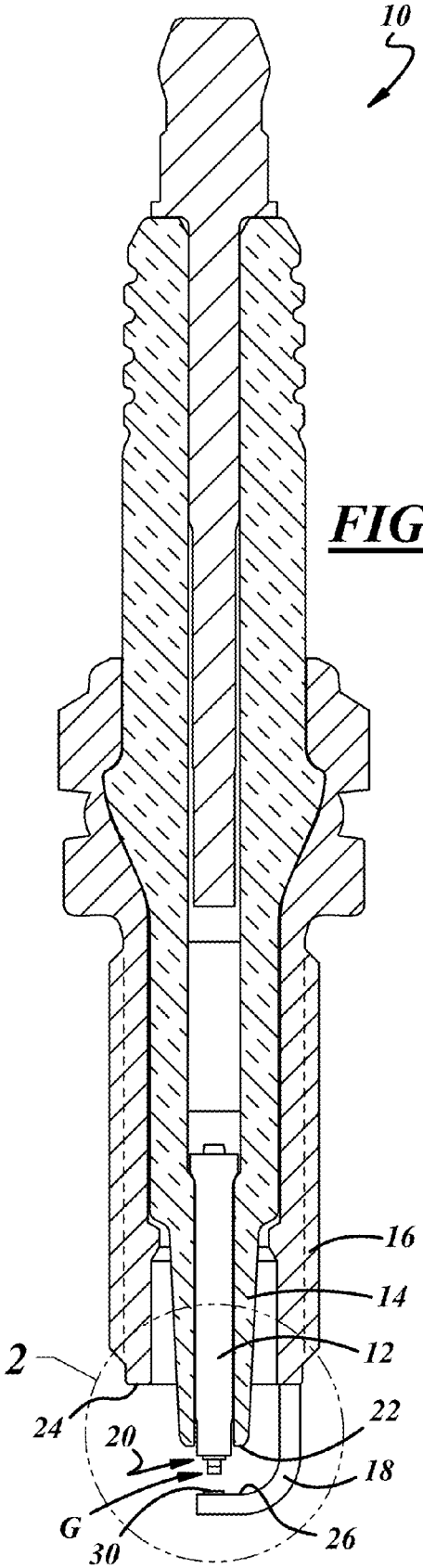
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible. All percentages provided herein are in terms of weight percentage (wt %).

Figure 2:
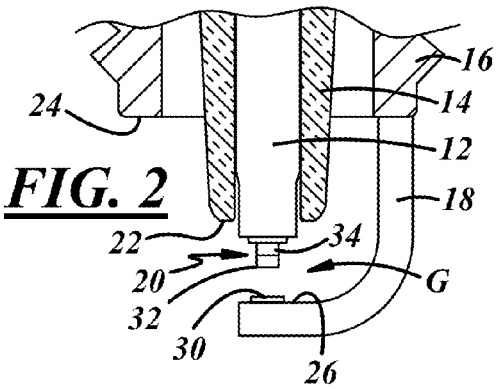
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
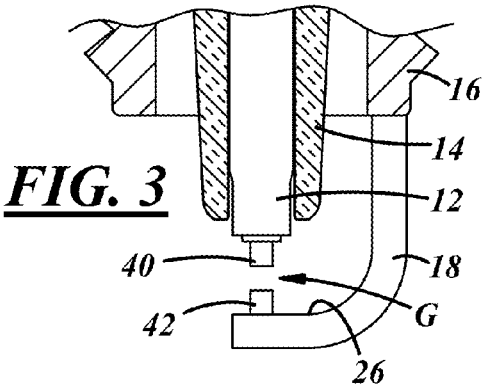
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
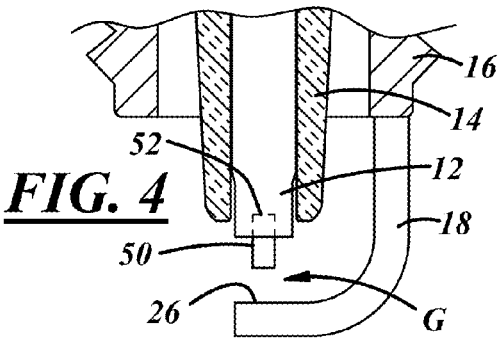
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
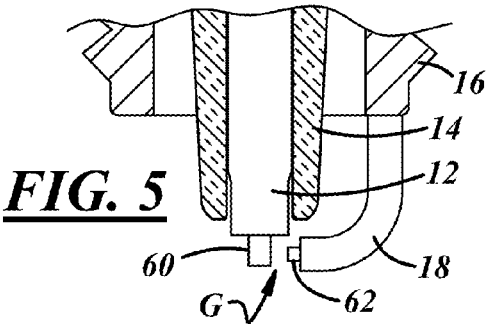
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

The electrode material described herein is a ruthenium-based material that also includes at least one of rhenium (Re) or tungsten (W). The electrode material is more ductile than some comparable ruthenium-based materials, yet still maintains an acceptable level of erosion and corrosion resistance. The ductility of these electrode materials makes them more workable so that they can be more easily turned into a useful part. For example, for the multi-layer rivet (MLR) design discussed above and shown in FIGS. 1-2, a firing tip component 32 made from these more ductile electrode materials can be sheared off from a wire during manufacturing and may avoid the use of a diamond saw or similar apparatus. In some embodiments, the ductility improvement in the electrode material is at least partially attributable to the addition of rhenium (Re) and the particular manufacturing techniques involved, such as the powder metallurgy sintering and other processes taught below.

The term "ruthenium-based material," as used herein, broadly includes any material where ruthenium (Ru) is the single largest constituent on a weight percentage (%) basis. This may include materials having greater than 50% ruthenium, as well as those having less than 50% ruthenium so long as the ruthenium is the single largest constituent. Skilled artisans will appreciate that ruthenium has a rather high melting temperature (2334° C.) compared to some precious metals, which can improve the erosion resistance of an electrode material including ruthenium. However, ruthenium can be more susceptible to oxidation than some precious metals, which can lower the corrosion resistance of the electrode material. Thus, the ruthenium-based material may include at least one of rhenium (Re) or tungsten (W), plus one or more precious metals and/or other metals. Some examples of suitable precious metals that may be used include rhodium (Rh), platinum (Pt), iridium (Ir) and combinations thereof. It is also possible for the ruthenium-based material to include one or more rare earth metals like yttrium (Y), hafnium (Hf), scandium (Sc), zirconium (Zr), lanthanum (La), cerium (Ce) and/or other constituents. The content of these rare earth metals or active elements in the electrode material may be in the range of about several ppm to about 0.3 wt %.

A number of the exemplary electrode materials described below include ruthenium (Ru), rhenium (Re) and tungsten (W), where the preferred ratio of rhenium to tungsten is 1:1, but this is not required as other ratios may be used instead. The following embodiments are examples of different electrode materials that may be used, but they are not meant to be an exhaustive list of all such embodiments, as others are certainly possible. It should be appreciated that any number of other constituents may be added to the following embodiments. A periodic table published by the International Union of Pure and Applied Chemistry (IUPAC) is provided in Addendum A (hereafter the "attached periodic table") and is to be used with the present application.

According to one embodiment, the electrode material includes ruthenium (Ru) from about 50 wt % to 99 wt %, rhenium (Re) from about 0.1 wt % to 10 wt % and tungsten (W) from about 0.1 wt % to 10 wt %. Some non-limiting examples of potential compositions for such alloys include (in the following compositions, the Ru constitutes the balance): Ru—10Re—10W, Ru—5Re—5W, Ru—2Re—2W, Ru—1Re—1W, Ru—0.5Re—0.5W and Ru—0.1Re—0.1W. An exemplary ternary alloy composition that may be particularly useful with spark plug electrodes is Ru—(0.5-5)Re—(0.5-5)W, such as Ru—1Re—1W, but others are certainly possible.

According to another embodiment, the electrode material includes ruthenium (Ru) from about 50 wt % to 99 wt %, rhenium (Re) from about 0.1 wt % to 10 wt %, tungsten (W) from about 0.1 wt % to 10 wt %, and a precious metal (other than the Ru just mentioned) from about 1 wt % to 40 wt %. Some examples of suitable electrode materials having only one precious metal added to the ruthenium-based material include: Ru—Rh—Re—W, Ru—Pt—Re—W, Ru—Ir—Re—W, Ru—Pd—Re—W and Ru—Au—Re—W alloys, where the ruthenium (Ru) is still the largest single constituent. Some non-limiting examples of potential compositions for such alloys include (in the following compositions, the Re and W contents are between about 0.1 wt % and 10 wt % and the Ru constitutes the balance): Ru—40Rh—Re—W, Ru—30Rh—Re—W, Ru—20Rh—Re—W, Ru—15Rh—Re—W, Ru—10Rh—Re—W, Ru—8Rh—Re—W, Ru—5Rh—Re—W, Ru—2Rh—Re—W, Ru—1Rh—Re—W, Ru—40Pt—Re—W, Ru—30Pt—Re—W, Ru—20Pt—Re—W, Ru—15Pt—Re—W, Ru—10Pt—Re—W, Ru—5Pt—Re—W, Ru—2Pt—Re—W, Ru—1Pt—Re—W, Ru—40Ir—Re—W, Ru—30Ir—Re—W, Ru—20Ir—Re—W, Ru—15Ir—Re—W, Ru—10Ir—Re—W, Ru—5Ir—Re—W, Ru—2Ir—Re—W, Ru—1Ir—Re—W, Ru—40Pd—Re—W, Ru—30Pd—Re—W, Ru—20Pd—Re—W, Ru—15Pd—Re—W, Ru—10Pd—Re—W, Ru—5Pd—Re—W, Ru—2Pd—Re—W, Ru—1Pd—Re—W, Ru—40Au—Re—W, Ru—30Au—Re—W, Ru—20Au—Re—W, Ru—15Au—Re—W, Ru—10Au—Re—W, Ru—5Au—Re—W, Ru—2Au—Re—W and Ru—1Au—Re—W. An exemplary quaternary alloy compositions that may be particularly useful with spark plug electrodes is Ru—(1-8)Rh—(0.5-5)Re—(0.5-5)W, such as Ru—5Rh—1Re—1W, where the amount of the precious metal is greater than at least one of the rhenium (Re) or the tungsten (W).

According to another embodiment, the electrode material includes ruthenium (Ru) from about 50 wt % to 99 wt %, rhenium (Re) from about 0.1 wt % to 10 wt %, tungsten (W) from about 0.1 wt % to 10 wt %, a first precious metal from about 1 wt % to 40 wt %, and a second precious metal from about 1 wt % to 40 wt %, where the first and second precious metals are different than the ruthenium (Ru) mentioned above. Some examples of suitable electrode materials having two precious metals added to the ruthenium-based material include: Ru—Rh—Pt—Re—W, Ru—Rh—Ir—Re—W, Ru—Rh—Pd—Re—W, Ru—Rh—Au—Re—W, Ru—Pt—Ir—Re—W, Ru—Pt—Pd—Re—W, Ru—Pt—Au—Re—W, Ru—Ir—Pd—Re—W, Ru—Ir—Au—Re—W and Ru—Au—Pd—Re—W alloys, where the ruthenium (Ru) is still the largest single constituent in the respective alloys. Some non-limiting examples of potential compositions for such alloys include (in the following compositions, the Re and W content is between about 0.1 wt % and 10 wt % and the Ru constitutes the balance): Ru—30Rh—30Pt—Re—W, Ru—20Rh—20Pt—Re—W, Ru—10Rh—10Pt—Re—W, Ru—8Rh—8Pt—Re—W, Ru—5Rh—5Pt—Re—W, Ru—2Rh—2Pt—Re—W, Ru—30Rh—30Ir—Re—W, Ru—20Rh—20Ir—Re—W, Ru—10Rh—10Ir—Re—W, Ru—8Rh—8Ir—Re—W, Ru—5Rh—5Ir—Re—W and Ru—2Rh—2Ir—Re—W, to cite a few possibilities. It is also possible for the electrode material to include three or more precious metals, such as Ru—Rh—Pt—Ir—Re—W, Ru—Rh—Pt—Pd or Ru—Rh—Pt—Au—Re—W. An exemplary composition that may be particularly useful with spark plug electrodes is Ru—(1-10)Rh—(1-10)Pt—(0.5-5)Re—(0.5-5)W, such as Ru—5Rh—5Pt—1Re—1W, but other alloy compositions are possible as well.

Depending on the particular properties that are desired, the amount of ruthenium (Ru) in the electrode material may be: greater than or equal to 50 wt %, 65 wt % or 80 wt %; less than or equal to 99%, 95 wt %, 90 wt % or 85 wt %; or between 50-99%, 65-99 wt % or 80-99 wt %, to cite a few examples. Likewise, the amount of either the rhenium (Re) or the tungsten (W) in the electrode material may be: greater than or equal to 0.1 wt %, 0.5 wt % or 1 wt %; less than or equal to 10 wt %, 5 wt % or 2 wt %; or between 0.1-10 wt %, 0.5-5 wt %, or 0.5-2 wt %. The amount of rhenium (Re) and tungsten (W) combined or together in the electrode material may be: greater than or equal to 0.5 wt %, 1 wt %, 1.5 wt % or 2 wt %; less than or equal to 10 wt %, 5 wt % or 2 wt %; or between 0.5-10 wt %, 1-5 wt % or 1-3 wt %. The amount of precious metal, such as rhodium (Rh), in the electrode material may be: greater than or equal to 1 wt %; less than or equal to 40 wt %, 8 wt %, 5 wt %, 3 wt % or 2 wt %; or between 1-40 wt %, 1-8 wt %, 1-5 wt %, 1-3 wt % or 1-2 wt %. The preceding amounts, percentages, limits, ranges, etc. are only provided as examples of some of the different material compositions that are possible, and are not meant to limit the scope of the electrode material.

One or more rare earth metals may be added to the various electrode material compositions described above, like yttrium (Y), hafnium (Hf), scandium (Sc), zirconium (Zr), lanthanum (La) or cerium (Ce). Those skilled in the art will appreciate that such metals can not only trap some impurities, but also help form rhenium-rich fine precipitates due to the low solubility in the ruthenium-based electrode material. Reducing the impurities in the matrix of the electrode material may increase the ductility of the ruthenium-based electrode material. The fine precipitates can play a role in pinning the grain boundary and preventing or controlling grain growth during certain processes and applications.

The rhenium (Re) and tungsten (W) in the ruthenium-based electrode material may provide the electrode material with certain desirable attributes, such as increased ductility, higher spark erosion resistance due to higher melting temperatures, and greater control of grain growth because of increased recrystallization temperatures, as mentioned above. More specifically, it is possible for the rhenium (Re) and/or tungsten (W) to improve the ductility of the electrode material by increasing the solubility or dissolvability of some interstitial components—interstitials like nitrogen (N), carbon (C), oxygen (O), sulfur (S), phosphorous (P), etc. can conjugate or gather near low energy positions on grain boundaries and thereby weaken the grain boundary rupture strength of the electrode material—so that the interstitials on grain boundaries are dissolved into the matrix or body of the Ru phase. This mechanism can reduce the impurities at the grain boundaries and thereby make the electrode material more ductile and workable, particularly during high-temperature processes. Although the present electrode material can be produced in a way that only includes Re or W, but not both, the co-addition of Re and W in a ruthenium-based alloy has shown a synergistic effect that improves ductility and formability. Some initial testing has demonstrated that when ruthenium-based materials including both Re and W were subjected to processes such as hot swaging, the resulting wire experienced fewer cracks and other surface imperfections than other ruthenium-based materials that lacked the synergistic inclusion of both Re and W.

The addition of rhenium (Re) and tungsten (W) to the electrode material may result in the grain boundaries becoming "rhenium-rich" and "tungsten-rich" during certain processing stages of the electrode material. For instance, rhenium- and tungsten-rich grain boundaries have higher concentrations of rhenium (Re) and tungsten (W) than is typically found inside the electrode material lattice or matrix; this may be particularly true during pre-sintering stages of the material. For example, during pre-sintering stages, the rhenium (Re) and tungsten (W) concentrations at the grain boundaries may be 50% higher or more than they are inside the lattice or matrix of the electrode material. Sintering causes some of the rhenium (Re) and tungsten (W) to disperse or diffuse into the electrode material lattice or matrix such that, during post-sintering stages, a composition gradient is established where the rhenium (Re) and tungsten (W) content is still highest at the grain boundary regions and decreases further inside of the lattice or matrix. The characteristics of the composition gradient can be influenced by the sintering temperature and time. Higher concentrations of rhenium (Re) and tungsten (W) near the grain boundaries may increase the solubility of certain impurities and thereby cause those impurities to dissolve in the ruthenium (Ru) matrix, as explained above.

Rhenium (Re) and tungsten (W) also have rather high melting points, thus, their addition to the ruthenium-based electrode material can increase the overall melting temperature of the material. The melting point of rhenium (Re) is approximately 3180° C. and that of tungsten (W) is around 3410° C. As those skilled in the art will appreciate, electrode materials having high melting temperatures are generally more resistant to electrical erosion in spark plugs, igniters and other applications that are exposed to similar high-temperature environments.

Figure 6:
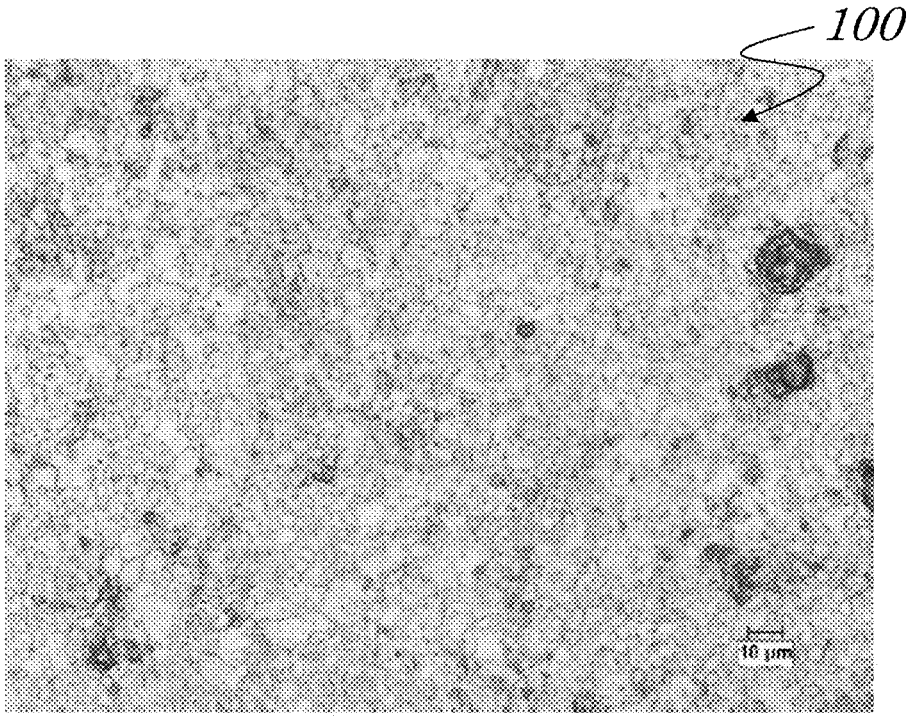
FIG. 6 is an enlarged micrograph of the microstructure of the electrode material described below after sintering but before extrusion, where the exemplary electrode material composition shown here is Ru—5Rh—1Re—1W.
Figure 7:
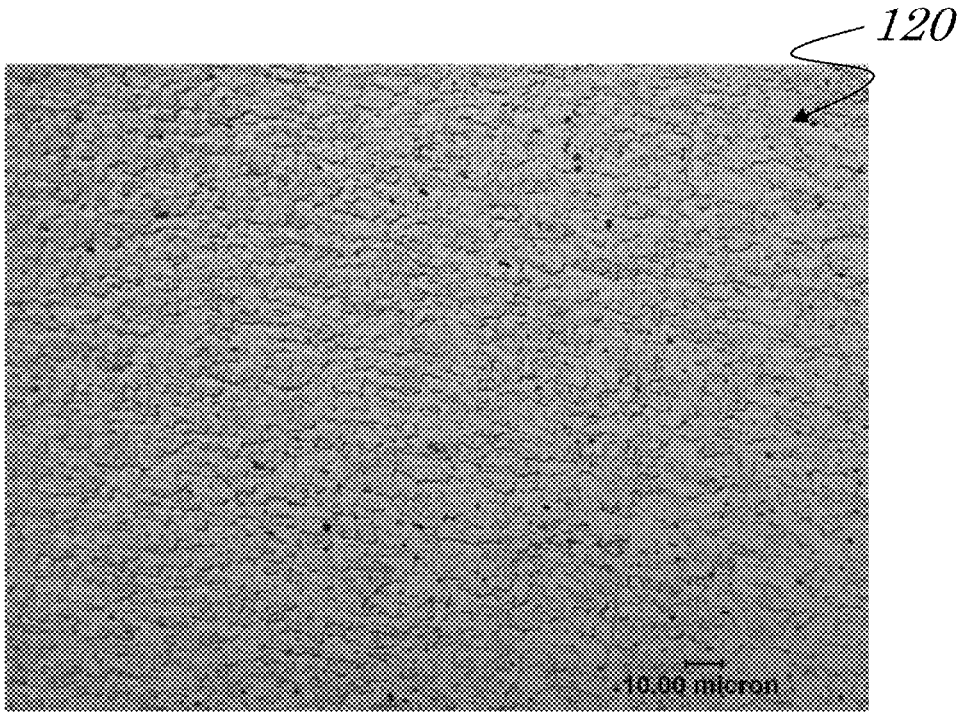
FIG. 7 is another enlarged micrograph of the microstructure of the electrode material described below after a hot forming process, where the exemplary electrode material composition shown here is again Ru—5Rh—1Re—1W.

The high melting points of the added rhenium (Re) and tungsten (W) can increase the recrystallization temperature of the overall electrode material by 50° C.-100° C. and, thus, rhenium (Re) and tungsten (W) may also be useful in controlling grain growth of the electrode material during certain high-temperature processes like sintering, annealing, hot swaging, hot extruding, and even during use or application at high temperatures. The recrystallization temperature of the ruthenium-based electrode material, with the appropriate amounts of rhenium (Re) and tungsten (W) added (e.g., Ru—(0.1-5)Rh—(0.1-2)Re—(0.1-2)W), is typically above 1400° C.; thus, hot forming processes below this temperature would not introduce abnormal grain growth. Testing reveals that abnormal grain growth of ruthenium-based alloys during hot forming processes can introduce cracking and failure. A micrograph of an exemplary grain microstructure 100 of the electrode material is shown in FIG. 6, where it is seen that the average grain dimension is generally between about 0-20 μm or, in some cases, less than or equal to about 10 μm. In this particular example, the particular electrode material is Ru—5Rh—1Re—1W and the grain microstructure is shown after the material has been sintered, but before it is extruded. FIG. 7 is also a micrograph showing a grain microstructure 120 of the same electrode material after a hot forming process, like hot swaging, and reveals that there is no significant grain growth after hot forming (in some cases of abnormal grain growth, the average grain size can grow to reach 100 μm-200 μm, for example). The term "grain growth," as used herein, refers to growth in the average size of the grain (i.e., the average surface area of the grain) during some type of high temperature or hot forming process. During a hot extruding process involving the present ruthenium-based electrode material, the grains may become somewhat elongated so that some of the dimensions of the grains increase in size in the direction of extrusion, however, there is generally no significant increase in the overall average size of the grains, on the order of what is described above.

Figure 8:
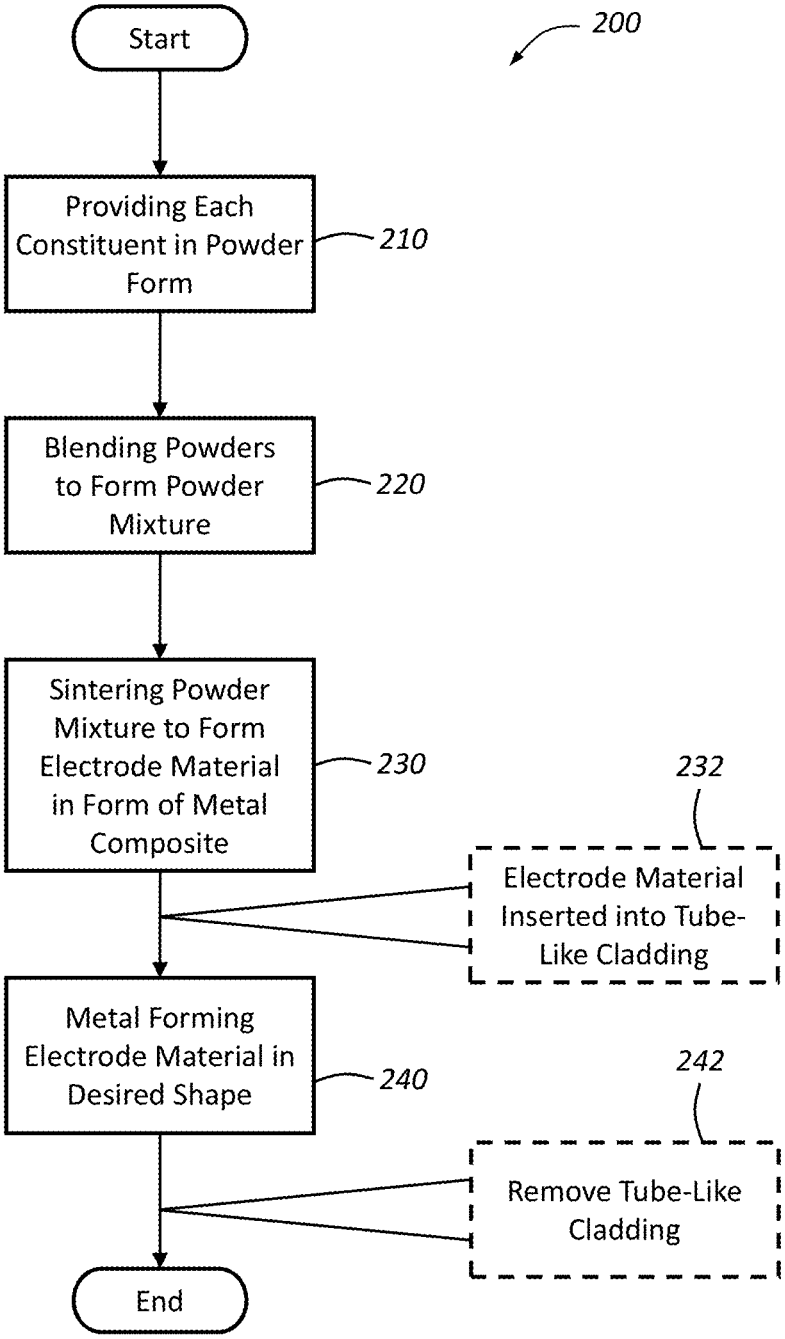
FIG. 8 is a flowchart illustrating an exemplary method for forming a spark plug electrode made from the electrode material described below.

Turning now to FIG. 8, the electrode material can be made using a variety of manufacturing processes, including a powder metallurgy method. For instance, a process 200 may be used that includes the steps of: providing each of the constituents in powder form where they each have a certain powder or particle size, step 210; blending the powders together to form a powder mixture, step 220; sintering the powder mixture to form the electrode material, step 230; and extruding, drawing or otherwise forming the electrode material into a desired shape, step 240. The process may further include one or more optional steps that provide a cladding or sheath around the electrode material.

In step 210, the different constituents of the electrode material may be provided in powder form. According to one exemplary embodiment, ruthenium (Ru), one or more precious metals (e.g., rhodium (Rh), platinum (Pt), iridium (Ir), etc.), rhenium (Re) and tungsten (W) are individually provided in a powder form where each of the constituents has a particle size that is about 0.1μ to 200μ, inclusive. In another embodiment, the ruthenium (Ru) and one or more of the constituents are pre-alloyed and formed into a base alloy powder first, before being mixed with the other powder constituents. The non-pre-alloying embodiment may be applicable to more simple systems (e.g., Ru—Re—W), while the pre-alloyed embodiment is better suited for more complex systems (e.g., Ru—Rh—Re—W, Ru—Rh—Pt—Re—W and Ru—Rh—Ir—Re—W).

Next, step 220 blends the powders together so that a powder mixture is formed. In one embodiment, the powder mixture includes from about 50 wt % to 99 wt % of ruthenium (Ru), from about 1 wt % to 40 wt % of rhodium (Rh), from about 0.1 wt % to 10 wt % of rhenium (Re), and from about 0.1 wt % to 10 wt % of tungsten (W). This mixing step may be performed with or without the addition of heat.

Sintering step 230 may be performed according to a number of different metallurgical embodiments. For instance, the powder mixture may be sintered in a vacuum, in a reduction atmosphere such as in a hydrogen-contained environment, or in some type of protected environment at a sintering temperature of about 0.5-0.8 $T_{melt}$ of the base alloy in order to form the electrode material. The term "base alloy," as it is used herein, generally refers to the alloy formed from all of the constituents except rhenium (Re) and tungsten (W). In the case of the Ru—Rh—Re—W alloy example above, the base alloy is the Ru—Rh and the sintering temperature may be between 1350° C. and 1650° C. It is also possible for sintering step 230 to apply pressure in order to introduce some type of porosity control to the electrode material. The amount of pressure applied may depend on the precise composition of the powder mixture and the desired attributes of the electrode material. Skilled artisans will appreciate that during the sintering process, the mixing and distribution of the different constituents within the material can depend on their mutual diffusion so that a composition gradient is formed from the grain boundary region to within the lattice or matrix. As explained above, FIG. 6 is a micrograph of an exemplary grain microstructure for the electrode material after sintering but before a hot forming operation, like hot extrusion. Generally speaking, single-phase solid solution ruthenium (Ru) is present in FIG. 6 with an average grain size that is less than or equal to about 10 μm.

Next, the electrode material may be formed into a wire (e.g., extruded, drawn, or swaged), it may be formed into a sheet (e.g., rolled), or it may be formed into a desired shape using some other suitable process, step 240. If a disk, log, or bar is desired, the electrode material may be subjected to sheet forming. If an elongated wire is desired, the electrode material may be warm or hot extruded to form a fine wire of about 0.3 mm to about 1.5 mm, inclusive, which in turn can be cut or cross-sectioned into individual electrode tips or the like. The electrode material is designed to have a higher room temperature ductility, which can be helpful if a lower extrusion temperature is desired. Of course, other metal forming techniques could be used with step 240 to form the electrode material in parts having different shapes. For example, the electrode material could be swaged, forged, cast or otherwise formed into ingots, sheets, bars, rivets, tips, etc.

The extrusion or wire drawing can be an important after-sintering process. This may be particularly true for ruthenium-based alloys that have a hexagonal close packed (hcp) crystal structure and poor ductility. Ruthenium-based alloys with an hcp crystal structure may have mechanical properties (e.g., strength and ductility) that are highly crystal orientation dependent. Because of the extrusion or wire drawing process, the ruthenium-based alloy wire can have a high texture microstructure, in which the hexagonal crystal axis of the ruthenium (Ru) phase is about 60°-90° in the wire direction. The degree of texture may be highly dependent on the total deformation during the wire drawing process. According to some embodiments, to get sufficient ductility the deformation should achieve at least 50% reduction in cross-sectional area during the wire drawing or swaging process. In one exemplary embodiment, the preferred area reduction can be as high as 90% after the wire drawing process. The reduction percent of area is defined as $R\% = (D_0^2 - D_f^2)/D_0^2$, where $D_0$ is the initial wire diameter before drawing and $D_f$ is the final wire diameter after wire drawing. A typical extrusion or wire drawing process may include hot drawing of the sintered bar at about the sintering temperature. The hot drawing process may take multiple passes with the wire diameter gradually reducing after each pass. The final wire may then be annealed at about the sintering temperature.

Figure 9:
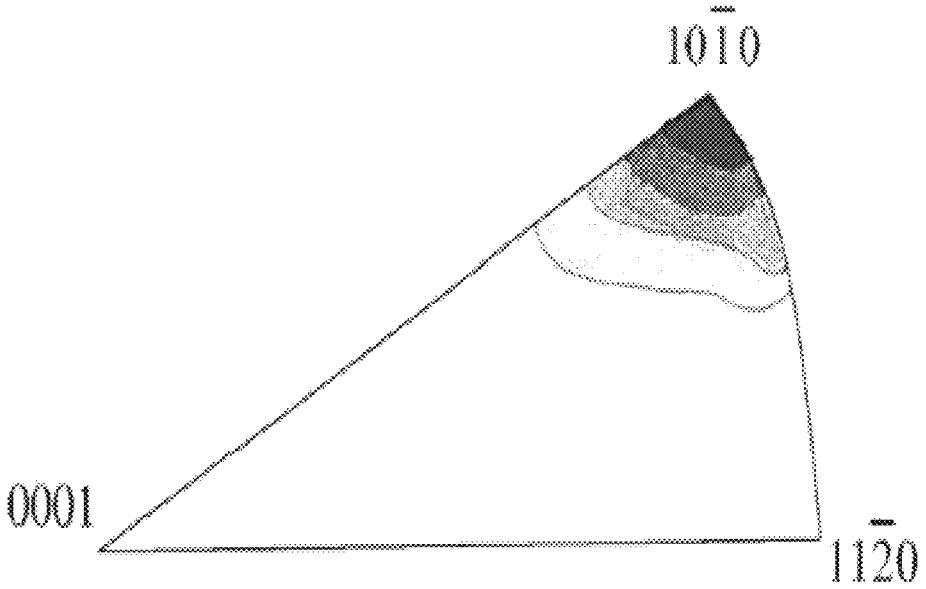
FIG. 9 is a plot showing an extrusion-axis inverse pole figure for the electrode material described below after a wire drawing process.

In some instances, the electrode material (e.g., fine wire such as 0.7 mm diameter wire) has a bending ductility that is greater than or equal to about 25% at room temperature. Bending ductility is generally defined as the angle of bend to crack for a test wire of 10 mm radius, as appreciated by skilled artisans. This bend ductility may be achieved for the electrode material by using the exemplary steps described above—which include the powder metallurgy sintering with rhenium (Re) and tungsten (W) additions to clear the grain boundary and wire drawing to form a texture structure. The texture analysis can be obtained, for example, by X-ray diffraction or electron back-scattered diffraction (EBSD) in association with scanning electron microscopy (SEM). FIG. 9 illustrates an extrusion-axis inverse pole figure of a powder metallurgy sintered ruthenium-alloy after an exemplary wire drawing step, showing that the dominant $[10\bar{1}\bar{0}]$ oriented grains are parallel to the extrusion axis after drawing. This plot also indicates that the dominant grains may have turned their [0001] hexagonal axis of crystals to a direction that is perpendicular to the extrusion axis.

In addition, the exemplary extrusion process may help achieve a highly elongated or "fiber" grain microstructure for the electrode material. A highly elongated or "fiber" grain microstructure for the electrode material may assist in absorbing the crack tip energy and blunting crack tip, and thereby help increase the toughness or overall durability of the electrode material. This may be particularly true because the electrode material is a ruthenium-based alloy.

To achieve a specific texture structure, a hot wire drawing process may be used. The final post-drawn product, for example a 0.7 mm diameter wire made from the present electrode material, can be chopped or sliced into pieces which can then be directly used as firing tip components mounted to a center electrode, ground electrode, intermediate component, etc. In one example, the sliced pieces are used as firing tip component 32 and are attached to intermediate component 34. The final electrode material may have a specific texture, in which the dominant grains have their [0001] hexagonal axis of crystals perpendicular to the elongation axis of the electrode. Of course, other processes such as rolling may be used to achieve a specific texture. After an exemplary hot rolling process, the [0001] axis of grains may be perpendicular to the rolling surface or sheet surface. Spark plug electrode components can be made by cutting a sheet in a correct direction so that the dominant grains having their [0001] hexagonal axis of crystals perpendicular to the elongation axis of electrode.

After the exemplary sintering and extrusion processes, the electrode material may have a bend ductility that is greater than or equal to about 25% at room temperature, as previously discussed. By providing a ruthenium-based material having such attributes, the material is able to enjoy the erosion and/or corrosion resistance of ruthenium (Ru), yet be somewhat ductile and thus workable so that the electrode material can be more easily turned into a useful part. This, in turn, may make the overall manufacturing process less expensive and less complex. Other benefits and/or attributes of the ductile electrode material may present themselves as well.

As mentioned above, it is also possible for method 200 to include an optional step where the electrode material is formed with a cladding or sheath made of a different material, so that the combined electrode material and cladding can be formed during step 240. In one embodiment, an additional step 232 is provided where the already sintered electrode material from step 230 is inserted or packed into a tube-like cladding structure. The cladding structure may be precious metal-based, nickel-based, nickel-iron-based, copper-based, or zinc-based, for example. In the event that cladding structure is precious metal-based, the cladding or sheathing may include pure platinum (Pt), pure palladium (Pd), pure gold (Au), pure silver (Ag), or some alloy thereof. Other cladding materials are also possible. A cladding structure having an outer diameter of about 0.2 mm-2.0 mm and a cladding wall thickness of less than about 150 μm may be used.

The above-described processes may be used to form the electrode material into various shapes (such as rods, wires, sheets, etc.) that are suitable for further spark plug electrode and/or firing tip manufacturing processes. Other known techniques such as melting and blending the desired amounts of each constituent may be used in addition to or in lieu of those steps mentioned above. The electrode material can be further processed using conventional cutting and grinding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to the metallic shell;

the center electrode, the ground electrode or both the center and ground electrodes including a ruthenium-based electrode material having ruthenium (Ru), rhenium (Re) and tungsten (W), wherein the electrode material includes rhenium (Re) from about 0.5 wt % to 2 wt %, inclusive, tungsten (W) from about 0.5 wt % to 2 wt %, inclusive, and ruthenium (Ru) is the single largest constituent of the electrode material on a weight percentage (wt %) basis.

2. The spark plug of claim 1, wherein the electrode material includes a combined amount of rhenium (Re) and tungsten (W) from about 1 wt % to 4 wt %, inclusive.

3. The spark plug of claim 1, wherein the electrode material includes a 1:1 ratio of rhenium (Re) to tungsten (W).

4. The spark plug of claim 1, wherein the electrode material further includes at least one precious metal, other than ruthenium (Ru), from about 1 wt % to 40 wt %, inclusive.

5. The spark plug of claim 4, wherein the electrode material includes at least one precious metal selected from the group consisting of: rhodium (Rh), platinum (Pt), palladium (Pd), iridium (Ir), or gold (Au).

6. The spark plug of claim 5, wherein the electrode material includes rhodium (Rh) from about 1 wt % to 8 wt %, inclusive.

7. The spark plug of claim 6, wherein the electrode material includes rhodium (Rh) from about 1 wt % to 5 wt %, inclusive.

8. The spark plug of claim 4, wherein the ruthenium (Ru) is the single largest constituent of the electrode material on a weight percentage (wt %) basis, the at least one precious metal is the second largest constituent of the electrode material on a weight percentage (wt %) basis, and at least one of the rhenium (Re) or the tungsten (W) is the third largest constituent of the electrode material on a weight percentage (wt %) basis.

9. The spark plug of claim 4, wherein the electrode material further includes a second precious metal selected from the group consisting of: rhodium (Rh), platinum (Pt), palladium (Pd), iridium (Ti), or gold (Au).

10. The spark plug of claim 1, wherein the electrode material further includes at least one rare earth metal selected from the group consisting of:

yttrium (Y), hafnium (Hf), scandium (Sc), zirconium (Zr), lanthanum (La), or cerium (Ce).

11. The spark plug of claim 1, wherein before the electrode material is subjected to a sintering process, the electrode material includes a grain microstructure that has a rhenium-rich grain boundary where the concentration of rhenium (Re) is higher than it is inside an electrode material matrix and has a tungsten-rich grain boundary where the concentration of tungsten (W) is higher than it is inside the electrode material matrix.

12. The spark plug of claim 1, wherein after the electrode material is subjected to a hot forming process, the electrode material includes a grain microstructure that does not exhibit significant grain growth of the average grain size compared to the same grain microstructure before the hot forming process.

13. The spark plug of claim 1, wherein the electrode material exhibits a bend ductility that is greater than or equal to about 25% at room temperature.

14. The spark plug of claim 1, wherein the center electrode, the ground electrode or both includes an attached firing tip that is at least partially made from the electrode material.

15. The spark plug of claim 1, wherein the center electrode, the ground electrode or both is at least partially made from the electrode material and does not include an attached firing tip.

16. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to the metallic shell;

the center electrode, the ground electrode, or both the center and ground electrodes including a ruthenium-based electrode material having ruthenium (Ru), rhodium (Rh), rhenium (Re) and tungsten (W), wherein the electrode material includes rhenium (Re) from about 0.1 wt % to 5 wt %, inclusive, tungsten (W) from about 0.1 wt % to 5 wt %, inclusive, a 1:1 ratio of rhenium (Re) to tungsten (W), and ruthenium (Ru) is the single largest constituent of the electrode material on a weight percentage (wt %) basis and the rhodium (Rh) is the second largest constituent of the electrode material on a weight percentage (wt %) basis.

17. The spark plug of claim 16, wherein the electrode material includes rhodium (Rh) from about 1 wt % to 40 wt %, inclusive.

18. The spark plug of claim 16, wherein the ruthenium (Ru) is the single largest constituent of the electrode material on a weight percentage (wt %) basis, the rhodium (Rh) is the second largest constituent of the electrode material on a weight percentage (wt %) basis, and at least one of rhenium (Re) or tungsten (W) is the third largest constituent of the electrode material on a weight percentage (wt %) basis.

19. The spark plug of claim 16, wherein before the electrode material is subjected to a sintering process, the electrode material includes a grain microstructure that has a rhenium-rich grain boundary where the concentration of rhenium (Re) is higher than it is inside an electrode material matrix and has a tungsten-rich grain boundary where the concentration of tungsten (W) is higher than it is inside the electrode material matrix.

20. The spark plug of claim 16, wherein after the electrode material is subjected to a hot forming process, the electrode material includes a grain microstructure that does not exhibit significant grain growth of the average grain size compared to the same grain microstructure before the hot forming process.

21. The spark plug of claim 16, wherein the electrode material exhibits a bend ductility that is greater than or equal to about 25% at room temperature.

22. An electrode for a spark plug, comprising:

a ruthenium-based electrode material having ruthenium (Ru), rhenium (Re) and tungsten (W), wherein the electrode material includes rhenium (Re) from about 0.5 wt % to 2 wt %, inclusive, tungsten (W) from about 0.5 wt % to 2 wt %, inclusive, and ruthenium (Ru) is the single largest constituent of the electrode material on a weight percentage (wt %) basis and the electrode material includes a grain microstructure that has rhenium-rich and tungsten-rich grain boundaries that are arranged to constrain ruthenium (Ru) grain growth during one or more hot forming processes.

* * * * *